United States Patent [19]

Fenyvesi

[11] Patent Number: 4,735,270

[45] Date of Patent: Apr. 5, 1988

[54] DRILLSTEM MOTION APPARATUS, ESPECIALLY FOR THE EXECUTION OF CONTINUOUSLY OPERATIONAL DEEPDRILLING

[76] Inventor: János Fenyvesi, Hungária krt. 163/b., H-1146 Budapest, Hungary

[21] Appl. No.: 872,667

[22] PCT Filed: Aug. 30, 1985

[86] PCT No.: PCT/HU85/00052

§ 371 Date: Jun. 26, 1986

§ 102(e) Date: Jun. 26, 1986

[87] PCT Pub. No.: WO86/01561

PCT Pub. Date: Mar. 13, 1986

[30] Foreign Application Priority Data

Sep. 4, 1984 [HU] Hungary ..... 3318/84

[51] Int. Cl.[4] ..... E21B 3/02; E21B 19/08

[52] U.S. Cl. ..... 175/113; 166/77; 173/145; 175/162; 175/195; 175/203; 226/173

[58] Field of Search ..... 175/113, 114, 162, 170, 175/121, 195, 203; 166/78, 77; 173/145, 147, 149; 226/172–175

[56] References Cited

U.S. PATENT DOCUMENTS

| | | | |
|---|---|---|---|
| 2,967,008 | 1/1961 | Johansson | 226/172 |
| 3,285,485 | 11/1966 | Slater | 166/77 |
| 3,363,880 | 1/1968 | Blagg | 166/77 |
| 4,429,753 | 2/1984 | Cushman | 175/149 |
| 4,431,063 | 2/1984 | Dressel et al. | 175/114 X |
| 4,515,220 | 5/1985 | Sizer et al. | 166/78 X |

*Primary Examiner*—James A. Leppink
*Assistant Examiner*—Hoang C. Dang
*Attorney, Agent, or Firm*—Schweitzer & Cornman

[57] ABSTRACT

A rotary drilling apparatus is disclosed, in which the pipe string is both lifted and lowered, as well as rotated, by an opposed pair of endless chains, eliminating the need for a high drilling tower structure. An advantageous form of gripping mechanism, attached to the chain links, enables the pipe string to be gripped with extremely heavy force, with the gripping means automatically confirming to pipe diameters of a variety of sizes and also conforming to the pipe coupling elements, as well as to the pipe areas inbetween, so that manipulation of the pipe string can be continuous. The gripping assembly includes a plurality of articulated gripping elements supported at each end by pivoted support arms. This assembly is urged against the pipe string by high pressure, hydraulic pistons.

3 Claims, 4 Drawing Sheets

DRILLSTEM MOTION APPARATUS, ESPECIALLY FOR THE EXECUTION OF CONTINUOUSLY OPERATIONAL DEEPDRILLING

The subject of this invention is a pipe stem driving apparatus, especially for the execution of continuously operational deep drilling, by means of which penetration into the solid mass of the earth, for the purpose of mining or study of the earth core, for example, or the discovery and production of liquid and gaseous fuels, can be carried out considerably faster and more expeditiously than with presently known apparatuses.

Known drilling apparatus, i.e. rotary drilling equipment, generally operates in a manner such that the drill pipe column or drill string, which is held together by pipe connectors and rotated axially, is provided at its bottom end with wing-, roller-, or diamond-type drill heads, and is provided at its upper end with fittings through which high pressure flushing fluid (drilling mud) is forced into the well in order to raise up to the surface the cuttings produced by the drilling. The elevation and suspension of the pipe string is manipulated by a lifting hook, placed in the crown section of the drilling tower. Rotation of the drill string is achieved by means of a turntable, with the aid of a four or six sided sectional rotating rod, screwed into the upper pipe of the drill string.

With the conventional rotary drilling apparatus, after every drill pipe feed, that is when the pipe string is sunk into the well by one pipe length, the drilling has to stop, the rotatry rod must be disconnected, the flushing fluid fitting removed. This enables a new section of pipe to be screwed onto the upper end of the pipe string, after which the rotating rod and the mud fitting are reconnected, and drilling proceeds. The drilling process with such apparatus is relatively inefficient, because the drilling operation has to be phased in steps, i.e. drilling phases followed by stoppage phases, during which additional sections of the pipe are connected.

In some rotary drilling apparatuses, the four or six sided rotating rod is eliminated, and the pipe string is driven by a drill chuck-type of clamping mechanism. Operations with this equipment are nevertheless phased, since drilling must be interrupted for the clamping mechanism to travel upwardly to obtain a new grip on the string. In addition, drilling has to stop while a new pipe is clamped in place. Moreover, apparatuses of this type are unsuitable for high powered transmission because of any relatively short area clamping mechanism. In general, these mechanisms are suitable only for smaller sized and relatively light weight drill strings. In some cases they are suitable only to a depth of about ten meters.

Rotary swivel head mechanisms are also known, which make unnecessary the use of the drilling rod, with rotation of the pipe string being achieved with the aid of a hydromotor. This solution also only partly eliminates the so-called phased operation, since the drilling of the well necessarily will be interrupted during the attachment of each pipe section. In addition, a fundamental handicap of this approach is that, because of its structural arrangement, it is useable only for drillings of relatively shallow depth.

In cases of drilling to great depth, the disadvantages of the apparatuses requiring considerable interruptions in the drilling processes become very apparent. Where there is wear or breakage at great depth, for example, a change of the drill head requires the total length of the pipe string to be taken out and replaced, section by section.

When drilling at depth of several kilometers, in extremely hard layers and in adverse conditions, it may be necessary to change the drill head 200–300 times, with the dismantling and rebuilding of the drill string being required in each instance. An improvement in the foregoing apparatuses is represented by U.S. Pat. No. 3,724,567, in which the drill head can be raised and lowered without dismantling the entire pipe string. The pipe string is laid out on an arc-shaped rail structure, by means of a trolley which is situated next to the drilling tower. Rotating of the pipe string is executed by means of a rotating rod. Raising of the pipe string is accomplished by means of a chain structure, placed at the base of the drilling tower, which is a lug-type having gripping devices able to engage the pipe string under the pipe connectors for raising and lowering the string.

Although the chain mechanism reduces the time required to accomplish a change in the drill head, the mechanism is not able to grip the drill pipe and thus is not used to rotate the pipe during drilling. In addition, becuase the mechanism is required to lift the pipe connectors to a considerable height, relatively high drilling towers are still required. The drilling tower in itself is a source of considerable danger, since its center of gravity is at a relatively high level, near the lifting hook mechanism, and particularly with offshore drilling rigs, gale force winds can result in toppling of the rig.

With the apparatus of the invention, many of the disadvantages of known drilling apparatus can be eliminated. Among these are the elimination of the drilling tower and the substantial reduction of time loss because of stoppages. In practice, drilling can be virtually continuous.

In accordance with the invention, the need for employment of a drilling tower can be eliminated by construction of a clamping mechanism which can grip the pipe string in such a way as to be able to both rotate as well as raise and lower the drill string simultaneously.

In accordance with the invention, highly efficient, substantially continuous drilling may be accomplished using an apparatus which includes a turntable for effecting rotation of the pipe string. Mounted on the rotary turntable is a pipe string driving and supporting apparatus, which is fixed to the turntable and has means for frictionally gripping the pipe string for rotatably driving the string as well as causing its raising and lowering.

The apparatus for driving the pipe string advantageously comprises two endless chain mechanisms, including two pairs of sprockets, rotational drive means, and an hydraulic force transmitting means for urging the individual chain links in a horizontal direction, into gripping engagement with a pipe string located in between.

In the apparatus of the invention, there is provided a static table and a movable turntable mounted thereon. Chain mechanisms, mounted on the rotary turntable, are driven through gear wheels located between the static and rotary tables. Hydraulic fluid, for applying grippng pressure to the individual chain links of the driving mechanism, may be introduced through the static and rotary tables, into a series of pressure pistons located behind the gripping chains.

The gripping of the pipe string by means of the chain mechanism is accomplished by means of novel clamping mechanisms mounted on each of the chain links. The gripping devices according to the invention are so efficient as to enable the gripping and rotating of a pipe string of extremely great length and weight, perhaps several thousand tons of weight. Each chain link is provided with a pressing bar, on which is mounted a pair of support arms capable of pivoting movement. The support arms engage articulated gripping elements between them such that the elements grip the pipe surface tightly when pressed thereagainst by the support arms.

Driving of the rotary turntable and also of the lifting and lowering chain mechanism advantageously is accomplished by a system of bevel gears, driven from an external soruce, which are arranged between the rotary and fixed tables and allow the chain to be driven in lifting/lowering directions while the rotary table is being driven rotationally.

The above and other features and advantages of the invention will be made evident from the following detailed description of a preferred embodiment of the invention, with reference to the accompanying drawings.

DESCRIPTION OF THE DRAWINGS

As shown in FIGS. 1 and 2, a driving mechanism is situated between a rotary table 3 and a static table 4. A tubular axle 51, mounting a bevel gear 10, is supported by a bearing 24 in the static table 4. A shaft 7 extends through the tubular shaft 51, being supported at its inner end by a bearing 25. A table-driving bevel gear 8 is mounted at the end of the shaft 7. The bevel gear 8 is meshed with a ring gear 9, fixed to the rotary table 3. The rotary table 3 itself is mounted on a self-aligning conic roller thrust bearings 5 and 6 carried by the static table 4. In the rotary table 3, in the area between the thrust bearings 5 and 6, there is provided an annular oil channel 49, on both sides of which are leakage preventing seals 44*a*, 44*b*. An oil connector 43, provided in the static table 4, connects with an oil passage 45*b* communicating with the annular channel 49. A second oil channel 45*a*, formed in the rotary table 3, leads from the channel 49 to an oil pressure manifold to be described, provided with an air accumulator 46.

Figure 1:
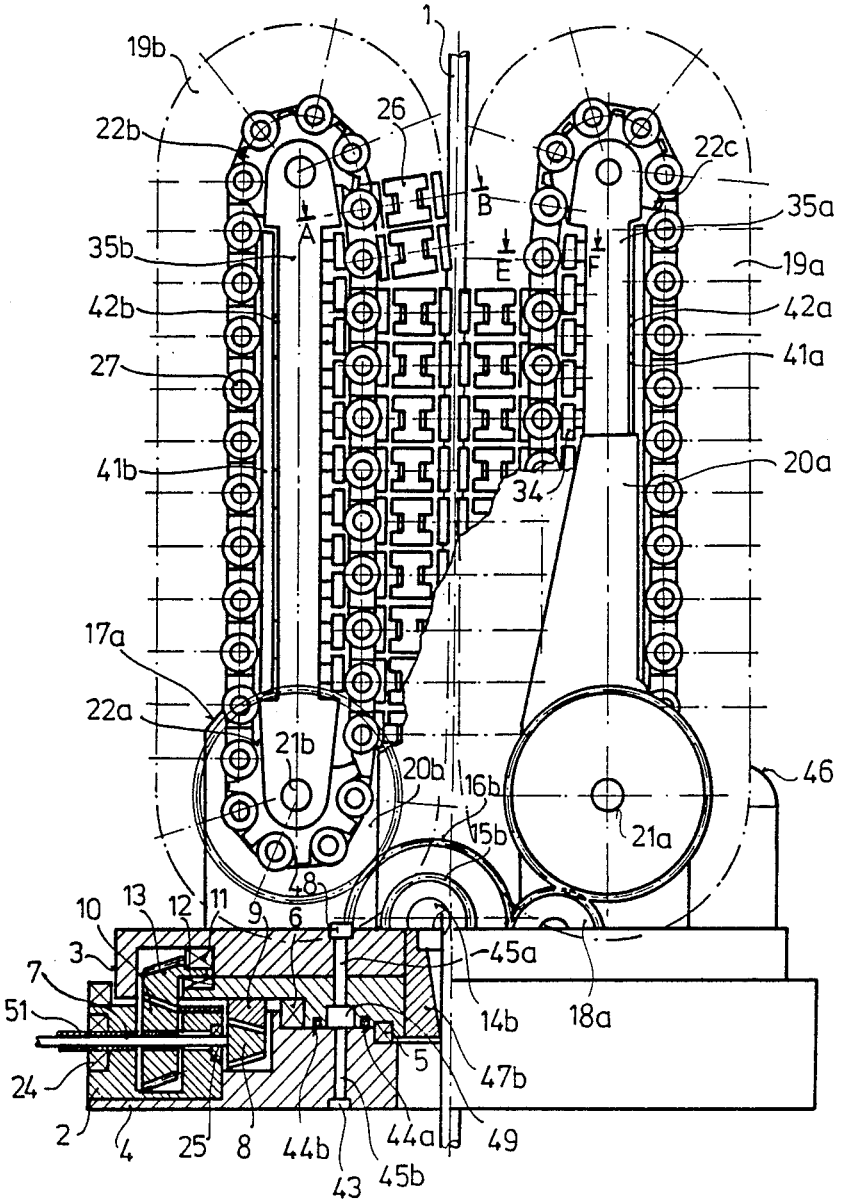
FIG. 1 is a side elevational view of the mechanism of the invention, with portions thereof being illustrated in cross section.

A bevelled ring gear 13 is rotatably mounted in the rotary table top 3, and is drivingly engaged by the bevel gear 10 mounted at the end of the tubular shaft 51. Uner the inner shoulder of the ring gear 13 is a thrust bearing 12, and above the shoulder is an upper thrust bearing 11. The ring gear 13 runs freely between these two thrust bearings. A first bevel gear 15*b* (FIG. 2) is meshed with the ring gear 13 and drives a shaft 14*b*. The shaft 14*b* drives a pinion 16*b*, which meshes with a drive gear 17*d* connected to a shaft 21*b* driving chain sprockets 22*c*, 22*d*. The pinion 16*b* also drives, through a direction reversing pinion 18*a*, a gear 17*a* connected through shaft 21*a* to chain sprockets 22*a*, 22*b*.

Endless chain structures 19*a*, 19*b* are held in vertically stretched-out position by chain support housings 35*a*, 35*b*. Supported vertically on the chain housings are chain tensioning tracks 41*a*, 41*b*, which are able to be moved outwardly by means of pressure pistons 42*a*, 42*b*. On the opposite side of the chain support housings, arranged one above the other, are a series of track elements 34, arranged to press against individual chain link assemblies 26 to urge them in a horizontal direction and thus press the gripping assemblies against the walls of the pipe string 1.

Arranged at the center of the rotary table 3 and surrounding the pipe string, is a holding wedge 47, which is arranged to grip the pipe string in cases of emergency.

Figure 2:
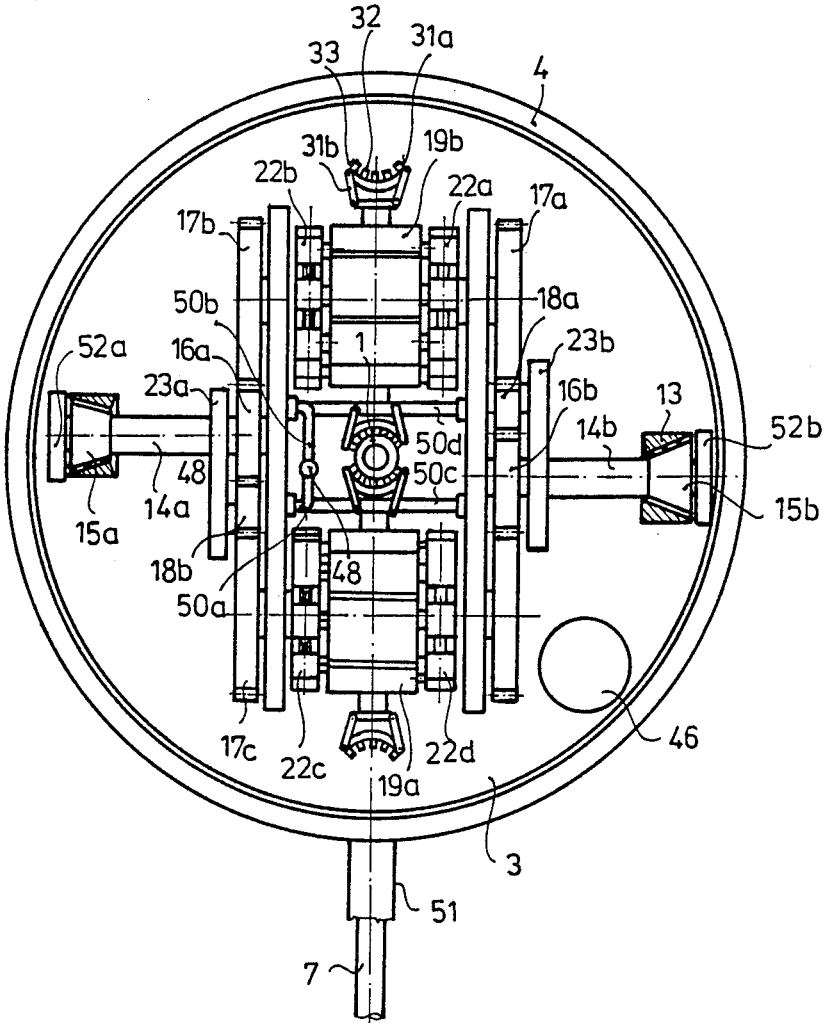
FIG. 2 is a top plan view of the apparatus of FIG. 1.

As is evident in FIG. 2, the separate chain structures are positioned to be driven from opposite sides by the gear system, which includes, at one side, the bevel gear 15*b*, gear 16*b*, gear 17*a* and 17*d* and the reversing pinion 18*a*. On the opposite side, the chains are driven by a system including the bevel gear 15*a*, pinion 16*a*, gears 17*b* and 17*c*, together with reversing pinion 18*b*.

The bevel gears 15*a*, 15*b* are supported, together with their shafts 14*a*, 14*b*, between bearings 52*a* and 23*a*, on the one hand, and 52*b*, 23*b* on the other. The bevel gears are meshed with the ring bevel gear 13 though openings formed in the rotary table top 3, as shown in FIG. 2.

An oil connector 48 is joined with pressure pipes 50*a*, 50*b*, 50*c* and 50*d*, which channel oil into closed oil areas connected with air accumulator drums 46 and surrounded by the endless chain structures 19*a*, 19*b*. Projecting into these oil areas are nine pairs of pistons 42*a*, 42*b*.

Figure 4:
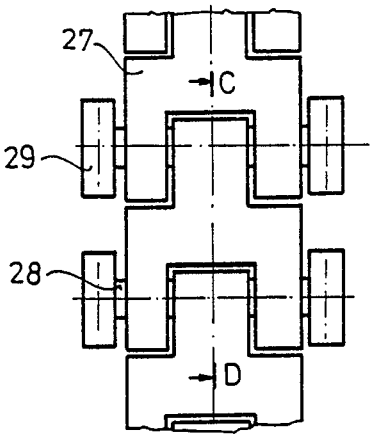
FIG. 4 is an enlarged, fragmentary illustration showing details of the chain link apparatus.
Figure 5:
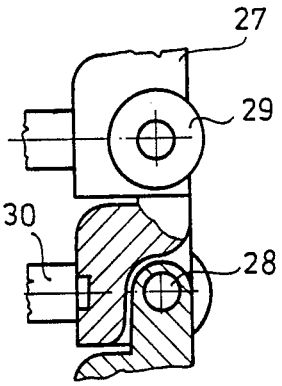
FIG. 5 is a cross sectional view as taken generally on line C-D of FIG. 4.
Figure 3:
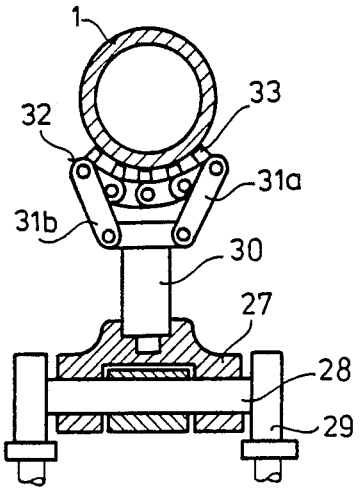
FIG. 3 is an enlarged, fragmentary cross sectional view taken generally along line A-B of FIG. 1, illustrating details of the pipe gripping mechanism of the invention.

The construction of the pipe gripping mechanism can be seen in FIGS. 3–5. A plurality of link-like articulated gripping segments 33 are arranged to contact a portion of the outer surface of the pipe string 1, adjusting to the pipe diameters and also to the pipe joints. The articulated segments 33 are hingedly connected at the ends to pivoting support arms 31*a*, 31*b* forming, together with the articulated links 33, gripping assemblies 32. The respective support arms 31*a*, 31*b* are pivotally mounted on pressure bars 30, which are in turn fixed on the chain link bodies 27, carried by spaced chain pins 28 and chain rollers 29.

Figure 7:
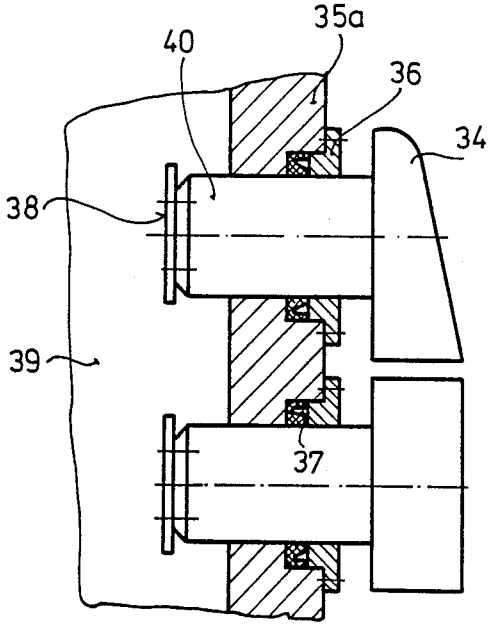
FIG. 7 is an enlarged, fragmentary cross sectional view as taken generally on line G-H of FIG. 6.
Figure 6:
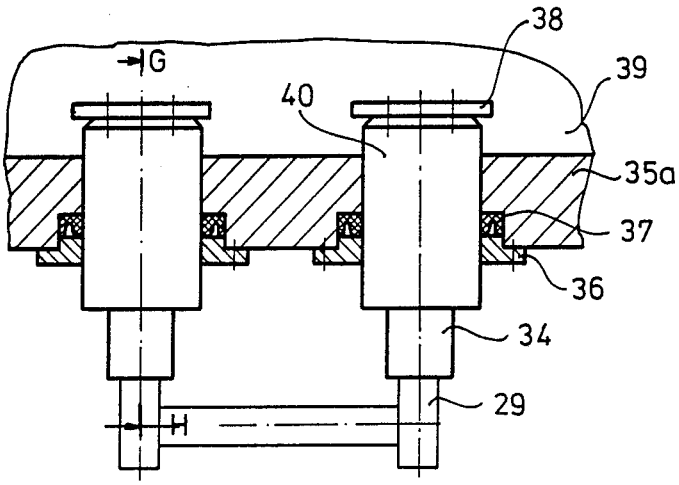
FIG. 6 is an enlarged, fragmentary cross sectional view as taken generally along line E-F of FIG. 1.

The hydraulic structure activating the pipe gripping mechanism can be observed in FIGS. 6 and 7. In the course of their vertical travel in contact with the pipe string 1, the chain rollers 29 move over the outer surfaces of track-forming elements 34. The track-forming elements 34 are fixed to the outer ends of pistons 40, arranged in bore holes of the chain mounting housings 35*a*, forming walls of oil manifold areas 39. On the inner ends of the pistons 40, which are in the oil manifold areas 39, buffer plates 38 are attached.

Suitable gasket elements 37, held with packing glands 36, surround the pistons 40 and prevent oil leakage.

The execution of continuous drilling by the pipe string moving apparatus according to the invention operates as follows:

The table-rotating shaft 7 of the power transmission apparatus 2 is connected to a suitable outside power source (not shown) and operates through the bevel gear 8 and ring gear 9 to rotate the rotary table 3 about a vertical axis, and with it the chain structures 19*a*, 19*b*. High pressure oil enters through the connector 43 into the circular oil channel 49, from the where the oil will arrive through the pressure pipes 50*a*, 50*b*, 50*c*, 50*d*, as shown in FIG. 2, into the high pressure oil manifold areas 39, shown in FIGS. 6 and 7. Likewise, as will be observed in FIGS. 6 and 7, the pistons 40, as a function of the oil pressure in the manifolds 39, will move in a horizontal direction, moving the chain members 26, fixed to the chain links 27 of the chain structures 19*a*, 19*b*. In this way, the chain links will press the articulated segments 33 against the mantle of the pipe string 1, as shown in FIG. 3.

The tensioning pistons 42*a*, 42*b*, situated on the side of the manifold opposite the piston pairs 40, insure a constant tension in the chain structures 19*a*, 19*b*.

The articulated segments 33, of the gripping assemblies 32, are able the adjust to the various diameters of the pipe string 1, thin or large pipes, pipe joints, etc. And by providing an appropriate number of chain assemblies 26 to be in gripping contact with the pipe string, the gripping elements are able to exert an extraordinary gripping power upon the pipe string, and are thus able to hold and move several thousand tons of pipe string weight.

For effecting vertical movement of the pipe string 1, the endless chain structures 19*a*, 19*b* are required to be moved in opposite directions to each other. This movement is effected from an outside power source connected to the tubular shaft 51 and transmitted through the bevel gear 10. The bevel gear 10 can rotate the ring gear 13 independently of rotations of the turntable 3. Hence, the ring gear 13 can either run ahead of the rotary turntable 3 or lag behind it. The bevel gears 15*a*, 15*b* meshing with the ring gear 13 thus will rotate the chain structure 19*b* in, for example, a clockwise direction, while the reversing pinion 18*a* will cause the opposing chain structure 19*a* to rotate in the opposite, in this case, counterclockwise direction. This causes the pipe string to be lowered in a controllable manner. Where the aim is to lift the pipe string, rotation of the tubular shaft 51 is controlled to be such, in relation to rotation of the turntable 3, that the chain structures 19*a*, 19*b* will be rotated in an opposite direction.

The frictional forces acting upon the pipe string 1, resulting from the hydraulic pressure of the manifold 39 acting on the pistons 40 and through them upon the pivoted support arms 31*a*, 31*b* and the articulated segments 33, are multiplied by the number of chain assemblies acting upon the pipe string and of course by the frictional coefficients of the gripping apparatus.

In the high pressure oil manifold areas 39, rapid loss of oil pressure, together with the possible slipping of the pipe string 1, is eliminated by the use of pressurized air accumulators 46. In addition, safety concerns are served by providing for a conventional holding wedge 47.

With the apparatus of the invention, the use of conventional drilling towers can be eliminated, enabling drilling of deep wells to be carried out on a substantially continuous basis, at lowr costs than with previously known structures. In addition, the apparatus of the invention provides for improved safety, by reason of eliminating the dangers of relatively high drilling structures.

I claim:

1. In an apparatus for advancing and withdrawing a rotatable drill pipe string and of the type comprising a rotary table provided with an opening for the passage of the pipe string, a pair of opposed gripping chains mounted on said table on opposite sides of the rotary axis thereof and having opposed portions extending along said axis for gripping opposite sides of said pipe string, and drive means for rotating said table and/or moving said gripping chains in an advancing or withdrawing direction, the improvement which comprises (a) said gripping chains including at least certain links having pipe gripping means mounted thereon, (b) said pipe gripping means including a plurality of articulated gripping elements forming a conformable gripping assembly engageable with a surface portion of a pipe section and substantially conformable to the contours thereof, and (c) support arms pivotally mounted to the links at one end and hingedly connected to the opposite ends of gripping assembly at the other end, said support arms movable toward and away from each other to accommodate conforming of said gripping assembly to the contours of said pipe string.

2. The improvement of claim 1, further characterized by (a) means being provided on said table for independently, forceably urging individual link portions of said gripping chains toward said pipe string, (b) said articulated gripping elements of each gripping assembly being automatically and independently conformable to varying contours of said pipe string as said string is advanced and withdrawn.

3. The improvement of claim 1, further characterized by (a) said pivotally mounted support arms extending divergently from said links toward said elements, whereby to place said articulated elements under tension when outward pressure is applied to said links in the direction of said pipe string.

* * * * *